United States Patent [19]

Herbig et al.

[11] Patent Number: 4,769,647

[45] Date of Patent: Sep. 6, 1988

[54] UNFOLDABLE AND REFOLDABLE ANTENNA REFLECTOR

[75] Inventors: Henning Herbig, Holzkirchen; Horst Heinze, Feldkirchen-Westerham, both of Fed. Rep. of Germany

[73] Assignee: Messerschmitt-Bölkow-Blohm GmbH, Munich, Fed. Rep. of Germany

[21] Appl. No.: 907,741

[22] Filed: Sep. 15, 1986

[30] Foreign Application Priority Data

Sep. 14, 1985 [DE] Fed. Rep. of Germany ..... 3532851

[51] Int. Cl.[4] ..... H01Q 15/20

[52] U.S. Cl. ..... 343/915

[58] Field of Search ..... 343/915, 912, 916

[56] References Cited

U.S. PATENT DOCUMENTS 3,780,375 12/1973 Cummings et al. ..... 343/915

4,030,103 6/1977 Campbell ..... 343/915

4,642,652 2/1987 Herbig et al. ..... 343/915

FOREIGN PATENT DOCUMENTS 0068137 1/1983 European Pat. Off. ..... 343/915

*Primary Examiner*—William L. Sikes

*Assistant Examiner*—Robert E. Wise

*Attorney, Agent, or Firm*—Kenyon & Kenyon

[57] ABSTRACT

An unfoldable and refoldable antenna reflector having support ribs which are linked to a support body, the support ribs being spaced from the latter approximately radially in the unfolded condition, for carrying a reflector screen or a reflector foil and which can be tilted up for refolding, folding elements being attached between adjacent support ribs which extend substantially transversely to the support ribs and are fastened at predeterminable spacings to the reflector screen or to the reflector foil, the spacings between the fastening points being shortened during refolding.

9 Claims, 2 Drawing Sheets

UNFOLDABLE AND REFOLDABLE ANTENNA REFLECTOR

BACKGROUND OF THE INVENTION

The present invention relates to an unfoldable and refoldable antenna reflector with support ribs which are linked to a support body, are distanced from the latter approximately radially in the unfolded position, carrying a reflector screen or mesh or a reflector foil and can be tilted up for refolding.

Such an antenna reflector is known from DE-OS No. 33 38 937. This involves an antenna reflector which can be used preferably for space travel and must be capable of being folded up in a small space in the storage space of the support rocket for the purpose of transporting. The antenna reflector therefore consists substantially of a central support body, to which rigid support ribs are linked which, in the unfolded condition, point radially outward and can be tilted up when folded together, so that they finally are nearly parallel to each other. To the support ribs, a metallic reflector screen is fastened which in the folded condition is brought into the desired, usually parabolic shape by means of adjusting devices.

In principle, a metallic or metalized reflector foil can, of course, also be used in such an antenna reflector instead of a reflector screen, although this is usually avoided for weight reasons. Therefore, only reflector screens will be mentioned in the following also as substitutes for reflector foils.

In a known antenna reflector of the above-mentioned type, the difficulty is now frequently encountered to accommodate the reflector screen in the very small space still remaining between the support ribs when refolding from the unfolded condition. It is to be noticed here that such antenna reflectors can have considerable diameters in the unfolded condition, so that antenna screens with correspondingly large areas must be used. To stow them away between the tilted-up support ribs in an orderly manner causes considerable difficulties, especially if done by hand. Finally, the reflector screen must be folded together between the support ribs in a small space in such a manner that it is not hung up at the support ribs or adjusting elements and can be unfolded again properly at any time. This problem has not been solved to date in a satisfactory manner.

SUMMARY OF THE INVENTION

It is therefore an object of the invention to make available an antenna reflector of the type mentioned at the outset, in which the reflector screen or mesh or the reflector foil can be folded up in a condition as ordered as possible in such a way that trouble-free unfolding and refolding is possible at any time.

According to the invention, this problem is solved by the provision that between adjacent support ribs, folding elements are attached which extend substantially transversely to the former and are fastened to the reflector screen or to the reflector foil at predeterminable spacings, where the refolding takes place while the spacings between the fastening points are successively shortened.

If at least one and preferably several such folding elements are attached within a sector formed in the unfolded condition of the antenna reflector by two adjacent support ribs, the reflector screen is folded up within the sector in an ordered manner when being refolded. This is accomplished particularly by the provision that the reflector screen is connected to the folding elements at preferably regular distances and these distances are at the same time shortened in the course of the refolding, whereby an ordered folding is quasi forced on the reflector screen between the fastening points. If within a sector several such folding elements extending essentially transversely to the support ribs are attached at certain radial distances from each other, it is advisable to provide always the same number of fastening points for each folding element in spite of the fact that the distances between the support ribs are increasing outward. Thereby the same number of folds is obtained from inside out in the reflector screen.

It is a common feature of the usable folding elements that they are connected essentially transversely to the support ribs at certain spacings, preferably to the underside of the reflector screen, and that they are capable, due to their special nature, of shortening these spacings when the antenna reflector is refolded in such a manner that the reflector screen is laid in ordered folds. Different embodiments of folding elements can be used.

Thus, wound springs which can be extended transversely to the support ribs can serve as folding elements. These can be attached to the adjoining support ribs as well as to fastening points in between at the reflector screen in such a manner that they are released in the folded state and are pulled apart during the unfolding and thereby come under tension. This tension will in general be relatively small especially in order to avoid additional forces that are exerted on the reflector screen which could have a detrimental effect on the pre-adjusted surface form.

It is further possible to use accordion-like foldable structures as the folding elements, which each consist of a number of platelets, rods or strips which are flexibly connected to each other and can be folded up in their entirety. In the case of, for instance, rectangular platelets, these may be connected to each other at their narrow sides by hinges, where every second of these hinges faces the underside of the reflector screen and is attached to the former at the fastening points. For refolding the antenna reflector or the reflector screen, these foldable structures consisting of platelets, rods or strips are then pushed together or folded by the support ribs which approach each other when they are tilted up. Also here, an ordered folding which is predetermined by the fastening points or the hinges is forced on the reflector screen. It is advisable to stabilize the foldable structure which consists, for instance, of platelets, in its position relative to the reflector screen by a guide cable. The latter can be brought through corresponding holes in the platelets, rods or strips and extends substantially transversely to the support ribs and parallel to the reflector surface as well as below the latter, i.e., on the back side of the reflector screen.

Instead of platelets, also woven ribbons with a base of aramide or carbon fibers can be used which are stiffened, for instance, with epoxy resin and then act like platelets. This stiffening is not applied at the joints (creases).

As further possibilities for designing the folding elements, only elastic ribbons shall be mentioned here which are bent in wave-shape in the unfolded condition of the antenna reflector and are stabilized in their position by a guidance cable. Such ribbons must be capable of being pushed together easily when refolded, in which process they then come under slight tension.

The three embodiments of folding elements mentioned above do not represent a complete listing. Rather, still other embodiments of the folding elements are conceivable which likewise fall under the principle of the invention.

Overall, the invention offers a multitude of advantages. It permits optimum utilization of the very limited stowage space for the antenna reflector during transport. It facilitates the repeated and reproducible unfolding and refolding for tests and trial purposes on the ground and in space. The reflector screen cannot jam during folding; it is protected against damage, has no tendency to wrinkle and is folded in an orderly manner and reproducibly as intended. Trouble-free unfolding is assured at any time. In repeated unfolding and refolding it is particularly disadvantageous especially on the ground that the force of gravity acts on the antenna screen, so that without the use of measures according to the invention, uncontrollable folding results. In the reflector of an offset antenna with a diameter of about 5.3 m as well as with a number of support ribs of 10, the maximum width of a sector located between two unfolded support ribs is about 170 cm. This width is reduced during refolding into the starting configuration to about 8 cm. This gives an idea as to the masses of a reflector screen including the adjusting elements attached thereto in a regular areal distribution in the small remaining space between two tilted-up, folded support ribs. This problem becomes more serious for folding ribs consisting of two rigid partial ribs, the outer partial rib of which is swung inward in the refolded condition of the reflector. The invention offers a practical solution to this problem also.

BRIEF DESCRIPTION OF THE DRAWINGS

In the following, the invention will be explained in greater detail by several embodiments referring to the figures, in which.

DETAILED DESCRIPTION

Figure 1:
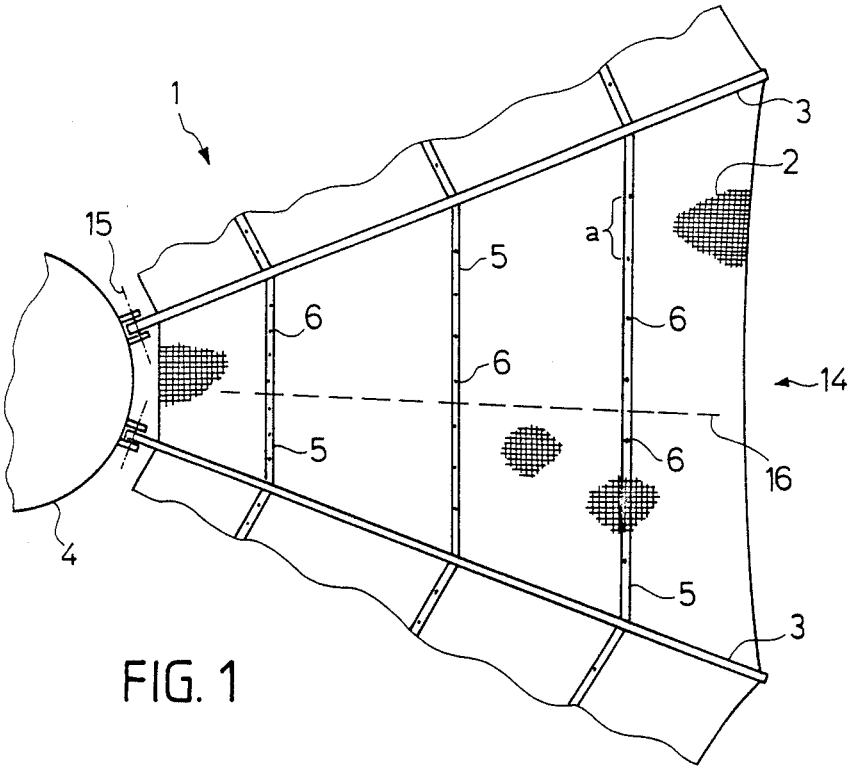
FIG. 1 show a sector of an antenna reflector of the invention in the unfolded condition with schematically shown folding elements.

In FIG. 1, a sector 14 of an antenna reflector 1 is shown schematically in the unfolded condition in a top view. Linked to a central support body 4 are support ribs 3 which can be tilted up about axes of rotation 15 in order to get into the refolded condition. In this condition, the support ribs 3 extend upwards almost vertically and are therefore oriented relative to each other nearly parallel. To the support ribs 3 is attached a reflector screen or mesh 2 which consists either of metal filaments or metalized plastic filaments. In the unfolded and adjusted condition, the surface of the reflector screen 2 is generally dished parabolically in good approximation. The reflector screen 2 can be fastened by means of spacers not shown, the length of which may also be adjustable, to the top side of the possibly likewise curved support ribs 3. Further adjustment elements not shown can be fastened and attached with their other ends to special guy wires or to a special adjusting network connected to the undersides of the support ribs 3. It becomes clear from the illustration that the space available for the reflector screen 2 is distinctly reduced after they are tilted up so that the reflector screen 2 can be put in definite and ordered folds during tilting up from the unfolded state in which it is under tension; three folding elements 5 are provided between the support ribs 3 within the sector 14 shown. The folding elements 5 are each connected at seven fastening points 6 to the reflector screen 2 from the underside thereof. The folding elements 5 are designed so that they have their highest points with periodic repetition at the fastening point 6 and are continued in between below the reflector screen 2. The folding elements 5 further have the property that they can be pushed or folded together when the support ribs are tilted up, so that the spacings A decrease successively between their fastening points 6. During the refolding of the antenna reflector 1, the reflector screen 2 will therefore be laid between the fastening points 6 in radially extending creases, of which one is indicated by the dashed straight line 16. These creases will be curved upward relative to the plane of the drawing. Thereby, an ordered folding motion is forced on the reflector screen 2 by the folding elements 5.

Figure 2A:
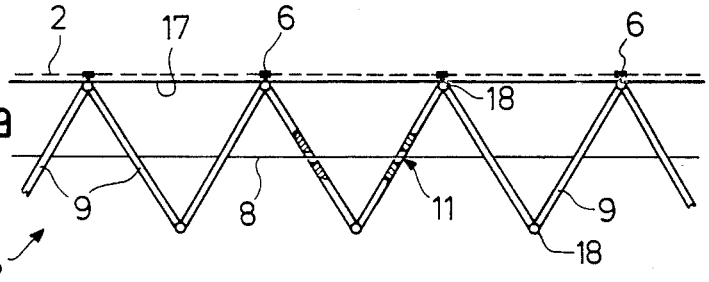
FIGS. 2*a* and 2*b* show a folding element of platelets flexibly connected to each other in two different positions.
Figure 2B:
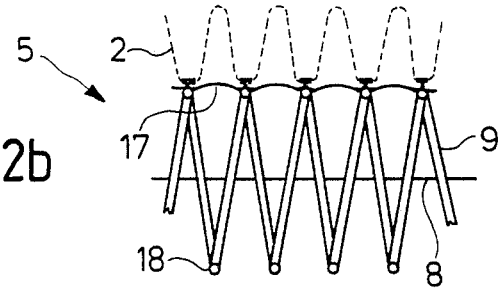

In FIGS. 2*a* and 2*b*, an embodiment of a folding element 5 is shown which consists of platelets 9 connected to each other by joints. The platelets have the form of elongated rectangles and are shown in FIGS. 2*a*, 2*b* as seen from the side. At the joints 18 facing the back side of the reflector screen 2, the folding element 5 is connected to the reflector screen 2 at the fastening points 6. Located below, an elastic pretensioned protective ribbon 17 is attached in the unfolded condition of the reflector screen shown in FIG. 2*a* . A guiding cable 8 is brought through holes in the platelets 9. While the support ribs 3 are tilted up, the platelets 9 are pushed together by the support ribs as is shown in FIG. 2*b*, while at the same time the guiding cable 8 is hauled-in via roll-up mechanisms attached in the support ribs 3 or at the support body 4 and is kept under tension. Furthermore, the protective ribbon 17 loses its pre-tension during the folding and prevents at the same time that the reflector screen 2 is folded inadvertently in the direction toward the folding element 5. The condition of the reflector screen 2 shown in FIG. 2*b* is therefore strictly given by the folding element 5 which is being pushed together. The platelets 9 can consist, for instance, of woven carbon (CFRP) or Kevlar Fibers, reinforced with plastic, and less of metals, for instance, aluminum for weight and thermal reasons.

The guiding cable 8 may consist of stainless steel or Kevlar (aramide) fibers and the protective ribbon 17 may consist of woven Kevlar or the same woven material as the reflector screen.

Figure 3:
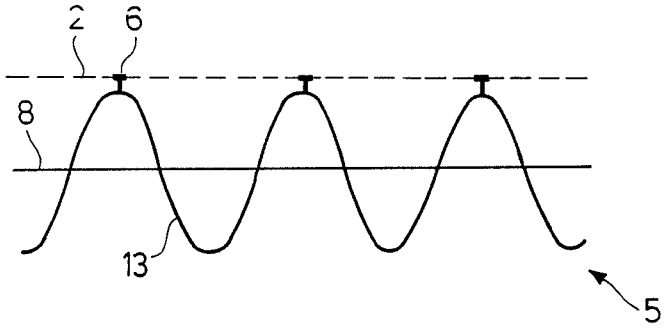
FIG. 3 shows a folding element of a wavy elastic ribbon.

In FIG. 3 a further embodiment of a folding element 5 is shown. In this case, the folding element 5 consists substantially of an approximately periodically bent elastic ribbon 13 which is stabilized likewise in its position by means of a guiding cable 8, guided through corresponding holes. The reflector screen 2 is connected at fastening points 6 to the curvatures of the elastic ribbon 13 oriented toward its back side. This elastic ribbon 13 may consist, for instance, of carbon fiber-reinforced plastic, Kevlar or metal. FIG. 3 shows the unfolded condition of the reflector screen 2, in which the elastic ribbon 13 already has a very small pre-tension due to its periodic curvatures. If the support ribs 3 are tilted up and the reflector screen 2 is at the same time folded together between the fastening points 6, the elastic ribbon 13 is compressed still further, but its elastic limit is not exceeded. Also here, the guiding cable 8 is hauled-in during the folding operation and is thereby kept under tension.

Figure 4:
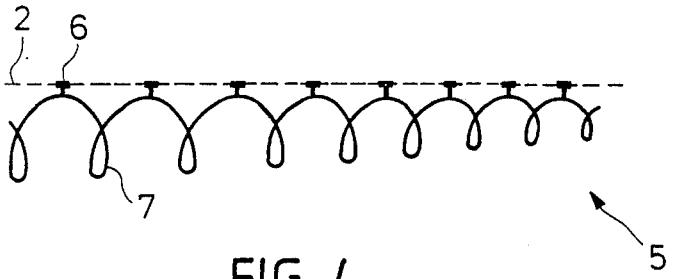
FIG. 4 shows a folding element of an extended wound spring.

A further, but not final, variant of a guiding element 5 is shown in FIG. 4 comprising a wound spring 7, consisting, for instance, of beryllium-copper. Shown is the unfolded condition of the reflector screen 2. The wound spring 7 is connected at the fastening points 6 to the underside of the reflector screen 2. Here also, an elastic protective ribbon, not shown however, is provided as in the case of FIG. 3 (see FIGS. 2*a* and 2*b*) so as to assure the desired direction of folding between the fastening points 6 for the reflector screen 2. The wound spring 7 is stretched to a certain degree in the unfolded condition of the reflector screen 2 according to FIG. 4 and is under tension even if it is small. In any case, attention should be given to the fact that such a wound spring, as well as the folding elements 5 shown before, do not have an adverse effect on the pre-adjusted surface shape of the reflector screen 2 in the unfolded condition.

In the foregoing specification, the invention has been described with reference to specific exemplary embodiments thereof. It will, however, be evident that various modifications and changes may be made thereunto without departing from the broader spirit and scope of the invention as set forth in the appended claims. The specification and drawings are, accordingly, to be regarded in an illustrative rather than a restrictive sense.

What is claimed is;

1. An unfoldable and refoldable antenna reflector having support ribs which are linked to a support body, said support ribs being spaced from the support body approximately radially in the unfolded condition, said support ribs for carrying a foldable reflector means and being tilted up for refolding, and further comprising a plurality of folding element means attached between adjacent support ribs which extend substantially transversely to the support ribs and each folding element means being fastened to the reflector means at a plurality of fastening points having predeterminable spacings, said spacings being shortened during refolding.

2. The antenna reflector recited in claim 1, wherein the folding element means comprise wound springs which can be extended substantially transversely to the support ribs.

3. The antenna reflector recited in claim 1, wherein the folding element means comprise a plurality of platelet means which can be folded together, said platelet means each comprising a plate-like structure fastened to other ones of said platelet means in accordion-like fsahion, the platelet means defining a line of points connected to the foldable reflector means.

4. The antenna reflector recited in claim 3, wherein the platelet means comprise woven platelets of aramide fibers stiffened with plastic without stiffening in folding regions thereof.

5. The antenna reflector recited in claim 3, further comprising guidance cables which are guided through holes in the platelet means and extending subtantially transversely to the support ribs and parallel to and beneath the reflector surface.

6. The antenna reflector recited in claim 6, further comprising wind-up means for hauling in the guidance cables during refolding.

7. The antenna reflector recited in claim 3, wherein the platelet measn comprises woven platelets of carbon fibers stiffened with plastic without stiffening in folding regions thereof.

8. The antenna reflector recited in claim 1, wherein the folding element means comprises, in the unfolded condition of the antenna reflector, elastic ribbons which are bent in wave-fashion and are stabilized in their position by respective guiding cables disposed through apertures located at predetermined points of said elastic ribbons.

9. The antenna reflector recited in claim 1, further comprising elastic ribbons attached on the side of the reflector means facing the folding element means between the fstening points pretensioned in the unfolded condition.

* * * * *